US007253813B2

(12) United States Patent
Yamada

(10) Patent No.: US 7,253,813 B2
(45) Date of Patent: Aug. 7, 2007

(54) ELECTRO-OPTICAL DEVICE, DRIVING METHOD THEREOF, AND ELECTRONIC APPARATUS

(75) Inventor: Tadashi Yamada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 441 days.

(21) Appl. No.: 10/353,933

(22) Filed: Jan. 30, 2003

(65) Prior Publication Data

US 2005/0041003 A1 Feb. 24, 2005

(30) Foreign Application Priority Data

Feb. 1, 2002 (JP) ..... 2002-026130
Jan. 30, 2003 (JP) ..... 2003-022024

(51) Int. Cl.
*G09G 5/00* (2006.01)
*G09G 3/30* (2006.01)

(52) U.S. Cl. ..... 345/207; 345/81

(58) Field of Classification Search ..... 345/76–81, 345/82, 83, 904, 84, 207; 348/180
See application file for complete search history.

(56) References Cited

U.S. PATENT DOCUMENTS 6,069,597 A 5/2000 Hansen
6,400,347 B1 6/2002 Kang
6,411,306 B1 * 6/2002 Miller et al. ..... 345/690
6,414,661 B1 * 7/2002 Shen et al. ..... 345/82
6,424,326 B2 * 7/2002 Yamazaki et al. ..... 345/77
6,556,258 B1 4/2003 Yoshida et al.
6,633,301 B1 * 10/2003 Dallas et al. ..... 345/84

FOREIGN PATENT DOCUMENTS

| | | |
|---|---|---|
| JP | U-60-033391 | 2/1985 |
| JP | A-4-233854 | 8/1992 |
| JP | A-7-074691 | 3/1995 |
| JP | A-10-254410 | 9/1998 |
| JP | A-11-154596 | 6/1999 |
| JP | A-11-214257 | 8/1999 |
| JP | A-11-265165 | 9/1999 |
| JP | A-2000-184013 | 6/2000 |
| JP | A-2000-270069 | 9/2000 |
| JP | A-2000-322022 | 11/2000 |
| JP | A-2000-332865 | 11/2000 |
| JP | A-2001-035655 | 2/2001 |
| JP | A-2001-075524 | 3/2001 |

(Continued)

OTHER PUBLICATIONS

English translation of p. 137 of *Electronic Display*, by Shoichi Matsumoto, published Jun. 20, 1996.

*Primary Examiner*—Kevin M. Nguyen
(74) *Attorney, Agent, or Firm*—Oliff & Berridge, PLC

(57) ABSTRACT

An electrooptical apparatus includes a plurality of scanning lines, a plurality of signal lines, and electrooptical devices, each being placed at an intersection of each of the scanning lines and each of the signal lines. The electrooptical apparatus is driven according to the amount of drive current supplied to the electrooptical devices. The electrooptical apparatus includes a brightness detection unit to detect the brightness of the electrooptical devices, and a drive current amount adjusting unit to adjust the amount of drive current based on the detected brightness result obtained by the brightness detection unit in order to correct for the brightness of the electrooptical devices.

13 Claims, 9 Drawing Sheets

(a)

(b)

FOREIGN PATENT DOCUMENTS

| | | |
|---|---|---|
| JP | A-2001-092412 | 4/2001 |
| JP | A-2001-222259 | 8/2001 |
| JP | A-2001-265283 | 9/2001 |
| JP | A-2001-290457 | 10/2001 |
| JP | A-2001-320474 | 11/2001 |
| JP | A-2001-350428 | 12/2001 |
| JP | A-2002-23686 | 1/2002 |
| KR | 2001-0023369 | 3/2001 |
| KR | 2001-0029073 | 4/2001 |
| TW | 400450 | 8/2000 |
| WO | WO98/40871 | 9/1998 |
| WO | WO 01/10291 A1 | 2/2001 |

* cited by examiner (a)

(b)

(a)

(b)

(a)

(b)

ELECTRO-OPTICAL DEVICE, DRIVING METHOD THEREOF, AND ELECTRONIC APPARATUS

BACKGROUND OF THE INVENTION

1. Field of Invention

The present invention relates to an electro-optical device, a driving method thereof, and an electronic apparatus.

2. Description of Related Art

In related art organic EL (electroluminescent) display devices, for example, the degradation of the luminous brightness of organic EL elements of the organic EL display devices over time is much more rapid than that of inorganic EL display devices. That is, as the lighting time accumulates, the reduction in brightness becomes noticeable. Specifically, the life of the inorganic EL display devices is over 100,000 hours, during which the reduction in brightness is hardly exhibited. In contrast, in the organic EL display devices, the lighting time with a luminance of, for example, 300 cd/$m^2$ is up to approximately 10,000 hours.

Accordingly, this drawback can be addressed or overcome by enhancing the manufacturing process, as disclosed in Japanese Unexamined Patent Application Publication No. 11-154596, and Japanese Unexamined Patent Application Publication No. 11-214257.

SUMMARY OF THE INVENTION

In reality, however, with the approach of enhancing the manufacturing process, it is difficult to completely prevent the reduction in brightness.

The present invention addresses or overcomes the above and/or other problems, and provides a technique of compensating for a change in brightness over time by use of an approach involving circuit technology.

The present invention provides a first electro-optical device having a plurality of scanning lines, a plurality of signal lines, and an electro-optical element placed at an intersection of each of the scanning lines and each of the signal lines, the electro-optical device being driven according to the amount of drive current supplied to the electro-optical elements. The electro-optical device includes a brightness detection unit to detect the brightness of the electro-optical elements; and a drive current amount adjusting unit to adjust the amount of drive current based on the detected brightness result obtained by the brightness detection unit in order to correct for the brightness of the electro-optical elements.

The amount of drive current is defined according to the value of the drive current and the length of a period in which the drive current is supplied to the electro-optical device.

The present invention also provides a second electro-optical device having a plurality of scanning lines, a plurality of signal lines, and an electro-optical element placed at an intersection of each of the scanning lines and each of the signal lines. The electro-optical device includes a driver which includes a D/A converter to convert digital data into analog data and which supplies the analog data to the electro-optical elements; a brightness detection unit to detect the brightness of the electro-optical elements; and a reference voltage adjusting unit to adjust a reference voltage for the D/A converter based on the detection brightness result obtained by the brightness detection unit.

The present invention also provides a third electro-optical device having a plurality of scanning lines, a plurality of signal lines, and an electro-optical element placed at an intersection of each of the scanning lines and each of the signal lines. The electro-optical device includes a driver to supply brightness data to the electro-optical elements; a control circuit to supply to the driver digital data which is a reference for the brightness data; a brightness detection unit to detect the brightness of the electro-optical elements; and a data correction circuit to correct the digital data based on the detected brightness result obtained by the brightness detection unit.

Typically, an electro-optical device, such as a liquid crystal device or an electroluminescent device, often includes three types of electro-optical elements for R (red), G (green), and B (blue). In such an electro-optical device, the above-noted electro-optical elements may include three types of electro-optical elements for R (red), G (green), and B (blue); the brightness detection unit may detect the brightness for each of the three types of electro-optical elements; and the drive current amount adjusting unit may adjust the amount of drive current based on the detected brightness for each type.

In a case where the three types of electro-optical elements illuminate R (red), G (green), and B (blue) light by passing light emitted from a common light source for the three types of electro-optical elements through a color conversion unit provided for each of the three types of electro-optical elements, the brightness detection unit may detect the brightness of the common light source for the brightness of the electro-optical elements. Alternatively, the brightness detection unit may detect the light passing through at least one of the color conversion units of the three types of electro-optical elements as the brightness of the electro-optical elements.

Preferably, the electro-optical device further includes a brightness detectability determination unit to determine whether or not the brightness detection by the brightness detection unit is possible.

It may also be determined whether or not the brightness detection performed by the brightness detection unit is possible based on the brightness of the electro-optical elements detected by the brightness detection unit.

An electronic apparatus according to the present invention includes the above-noted electro-optical device.

The present invention also provides a first driving method of an electro-optical device having a plurality of scanning lines, a plurality of signal lines, and an electro-optical element placed at an intersection of each of the scanning lines and each of the signal lines, the electro-optical device being driven according to the amount of drive current supplied to the electro-optical elements. The driving method includes: detecting the brightness of the electro-optical elements, and adjusting the amount of drive current based on the detection result obtained in the first step.

The present invention also provides a second driving method of an electro-optical device having a plurality of scanning lines, a plurality of signal lines, an electro-optical element placed at an intersection of each of the scanning lines and each of the signal lines, and a driver which includes a D/A converter to convert digital data into analog data and which supplies the analog data to the electro-optical elements. The driving method includes: detecting the brightness of the electro-optical elements, and defining a reference voltage for the D/A converter based on the detection result obtained in the first step.

The present invention also provides a third driving method of an electro-optical device having a plurality of scanning lines, a plurality of signal lines, and an electro-optical element placed at an intersection of each of the scanning lines and each of the signal lines, brightness data being supplied to the electro-optical elements via a driver. The driving method includes: detecting the brightness of the electro-optical elements, and correcting the digital data based on the detection result obtained in the first step.

In the above-noted driving method, in the detecting, preferably, the brightness is detected for each of three colors, R (red), G (green), and B (blue).

Prior to the detecting, it may be determined in advance whether or not the brightness detection is possible.

It may also be determined whether or not the brightness detection by the brightness detection unit is possible based on the detected brightness of the electro-optical elements.

In the present invention, pixel colors are not limited to three colors, R, G, and B (red, green, and blue), and any other color may be used.

Other features of the present invention will become apparent from the accompanying drawings and the following description.

DETAILED DESCRIPTION OF PREFERRED EMBODIMENTS

An exemplary embodiment of the present invention is described below. In this exemplary embodiment, an electro-optical device implemented as a display device (hereinafter "an organic EL display device") which employs organic electroluminescent elements (hereinafter "organic EL elements"), and a driving method thereof are described, by way of example.

First, the organic EL display device is briefly described. As is well known in the art, an organic EL panel constituting the organic EL display device is formed of a matrix of unit pixels including organic EL elements. The circuit structure and operation of the unit pixels are such that, for example, as described in a book titled "ELECTRONIC DISPLAYS" (Shoichi Matsumoto, published by Ohmsha on Jun. 20, 1996) (mostly, page 137), a drive current is supplied to each of the unit pixels to write a predetermined voltage to an analog memory formed of two transistors and a capacitor so as to control lighting (illumination) of the organic EL elements.

In the exemplary embodiments according to the present invention, the brightness of the display panel of the organic EL display device is detected by a brightness sensor for brightness correction based on the detection result.

First Exemplary Embodiment

Figure 1:
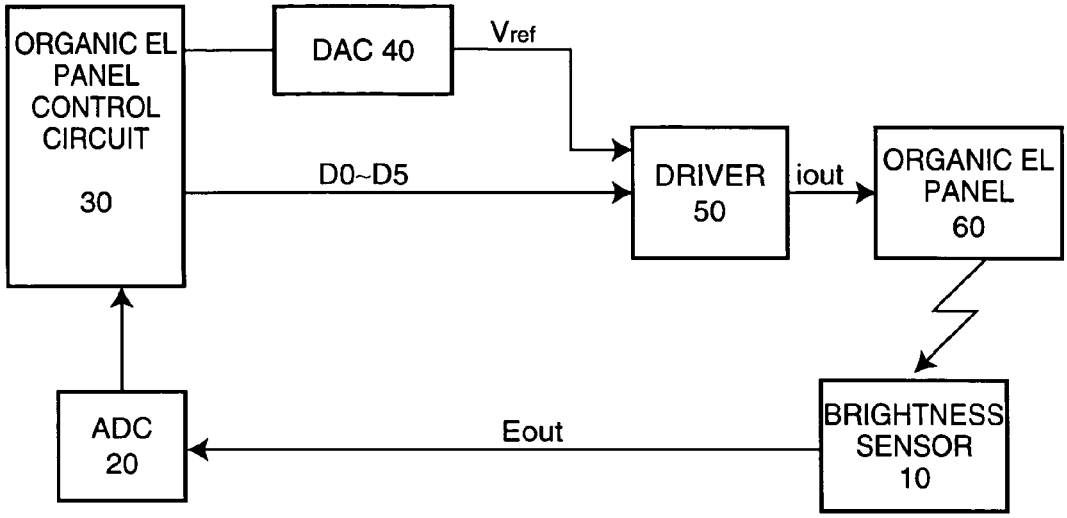
FIGS. 1(*a*) and 1(*b*) are schematics of an organic EL display device according to the present invention, where FIG. 1(*a*) is a schematic of the control of the overall device, and FIG. 1(*b*) is a schematic of the control of an organic EL control circuit 30.
Figure 1:
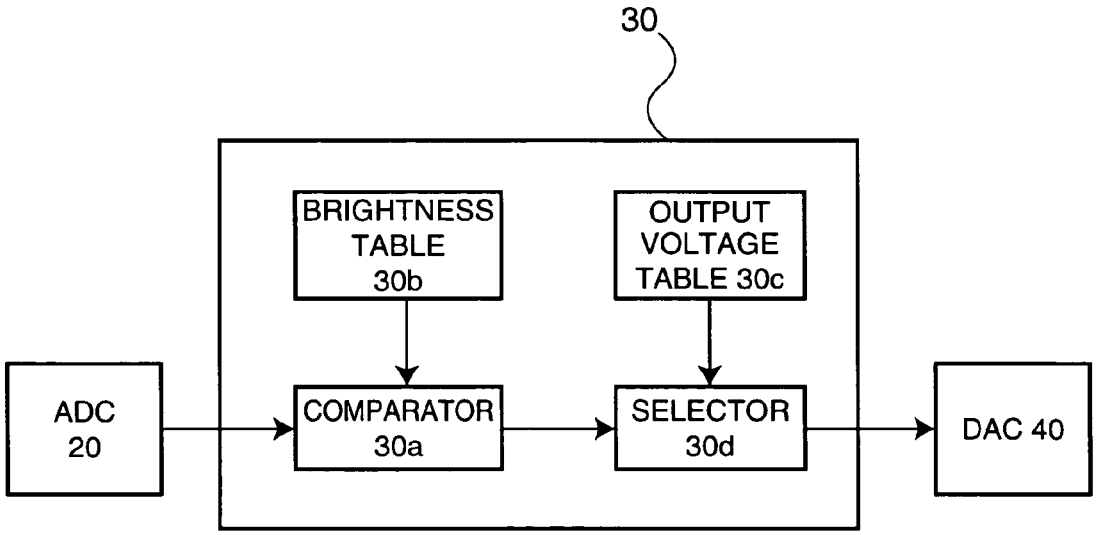

As shown in FIG. 1(*a*), an organic EL display device according to the first exemplary embodiment includes a brightness sensor 10 formed of a photodiode or a CCD element, a C-MOS element, and so on, an ADC (analog-to-digital converting circuit) 20, an organic EL panel control circuit 30, a DAC (digital-to-analog converter) 40, a driver 50 including a current generating circuit for generating a data current corresponding to digital data, and an organic EL panel 60. As shown in FIG. 1(*b*), the organic EL panel control circuit 30 includes a comparator 30*a*, a brightness table 30*b*, an output voltage table 30*c*, and a selector 30*d*.

The brightness sensor 10 has a element to determine whether or not light is shielded so as not to detect external light other than the light of the organic EL panel 60. This light shielding unit is described below in conjunction with application examples. The organic EL panel control circuit 30 can be configured by hardware using a circuit to achieve functions, or by software using a microcomputer to achieve the functions.

As discussed above, the organic EL panel 60 may be formed of a plurality of organic EL elements having light-emitting layers for R (red), G (green), and B (blue) light, or may be formed of a plurality of organic EL elements having color conversion layers for R (red), G (green), and B (blue) for converting light emitted from a common white light source into R (red), G (green), and B (blue) light.

First, the overall operation is described. Light emitted from the organic EL panel 60 is detected by the brightness sensor 10, and a voltage Eout indicating the detection result is output to the ADC 20. The voltage Eout is converted by the ADC 20 into a digital signal, which is then output to the organic EL panel control circuit 30. The comparator 30*a* which receives the digital signal refers to the predetermined brightness table 30*b* stored in a non-volatile memory or the like to determine whether or not the detected brightness is the predetermined brightness. The brightness data of the brightness table 30*b* to be compared with the detection result Eout may be selected in accordance with given digital data h.

The comparison result is output to the selector 30*d*. As described in detail below, the selector 30*d* which receives the comparison result outputs an instruction value to, the DAC 40 so that an appropriate reference voltage Vref is output from the output voltage table 30*c* based on the comparison result. In response to the instruction value, the DAC 40 outputs the corrected reference voltage Vref, as described in detail below, to a DAC included in the driver 50. The reference voltage Vref is a reference voltage based on which the digital data h is converted by the DAC of the driver 50 into an analog value. In this way, analog data to be supplied to the organic EL panel 60 is corrected based on the detection result.

Figure 2:
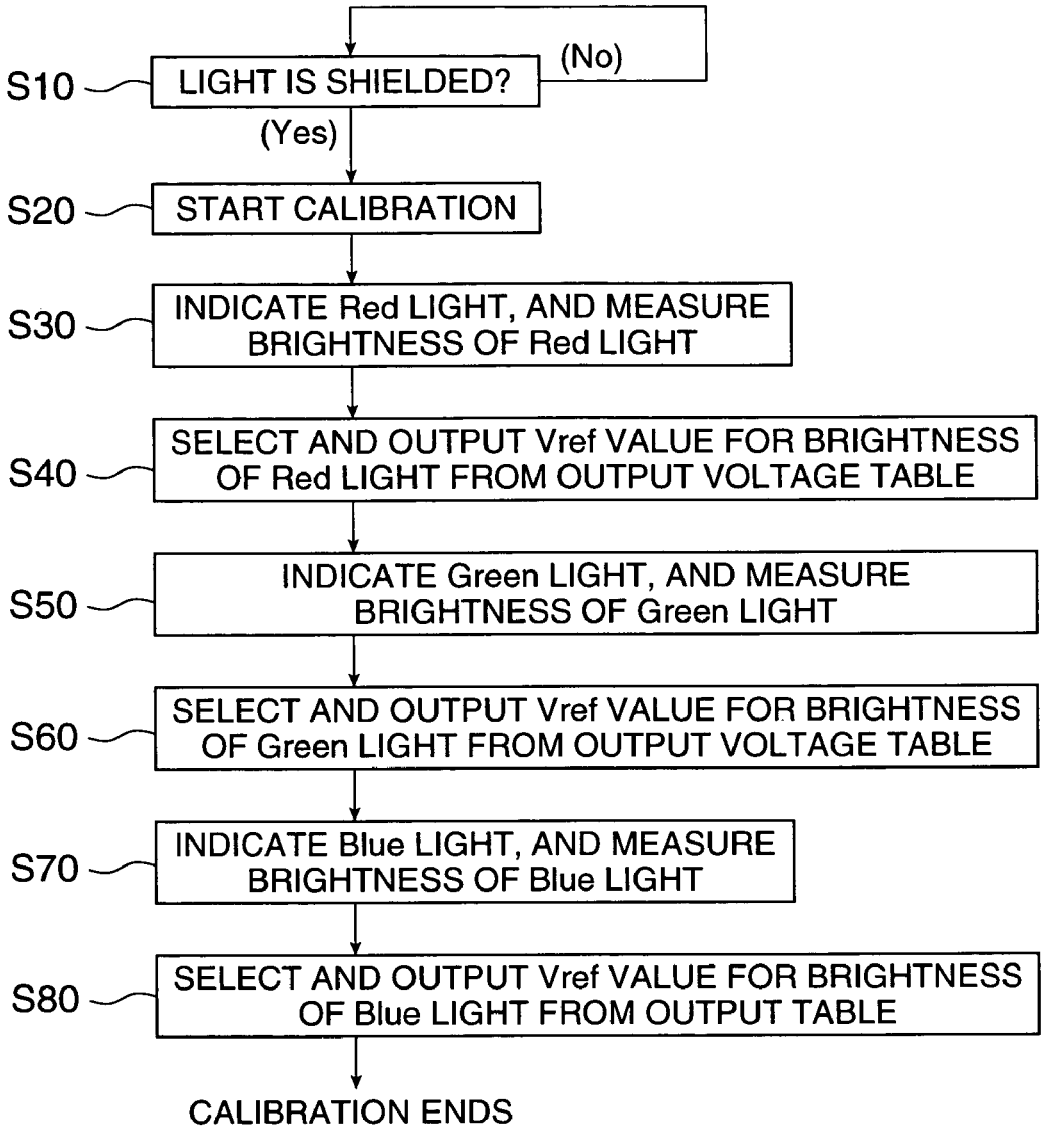
FIG. 2 is a flowchart showing a sequence control of brightness correction of the organic EL display device according to the present invention.

A specific technique of brightness correction is described below. As depicted in the flowchart of FIG. 2 showing an adjustment sequence, in order to accurately measure the brightness, it is determined whether or not light is shielded (S10). When light is shielded, adjustment (in FIG. 2, calibration) starts (S10: YES, then the process proceeds to S20). Then, with reference to the above-described output voltage table 30*b* shown in FIG. 1(*b*), the reference voltage Vref is determined for each color of R (Red), G (Green), and B (Blue) (S30 through S80).

When the organic EL panel 60 is formed of a plurality of organic EL elements having color conversion layers for R (red), G (green), and B (blue) for converting light emitted from a common white light source into R (red), G (green), and B (blue) light, the brightness of the common white light source may be detected, or the brightness of at least one of the R (red), G (green), and B (blue) light may be detected.

Second Exemplary Embodiment

In the second exemplary embodiment, the brightness is measured without the output voltage table used in the first exemplary embodiment, and is adjusted until the reference voltage Vref is corrected to achieve a target brightness. Thus, the structure of the overall device of the second exemplary embodiment is similar to that shown in FIG. 1(*a*), but the organic EL panel control circuit 30 is formed of a programmable microcomputer or the like for executing an adjustment sequence shown in FIG. 3 in place of the structure shown in FIG. 1(*b*). This allows the reduction in circuit dimension compared to the first exemplary embodiment. The other components are common to those described above in the first embodiment, and the difference therebetween is primarily described below.

Figure 3:
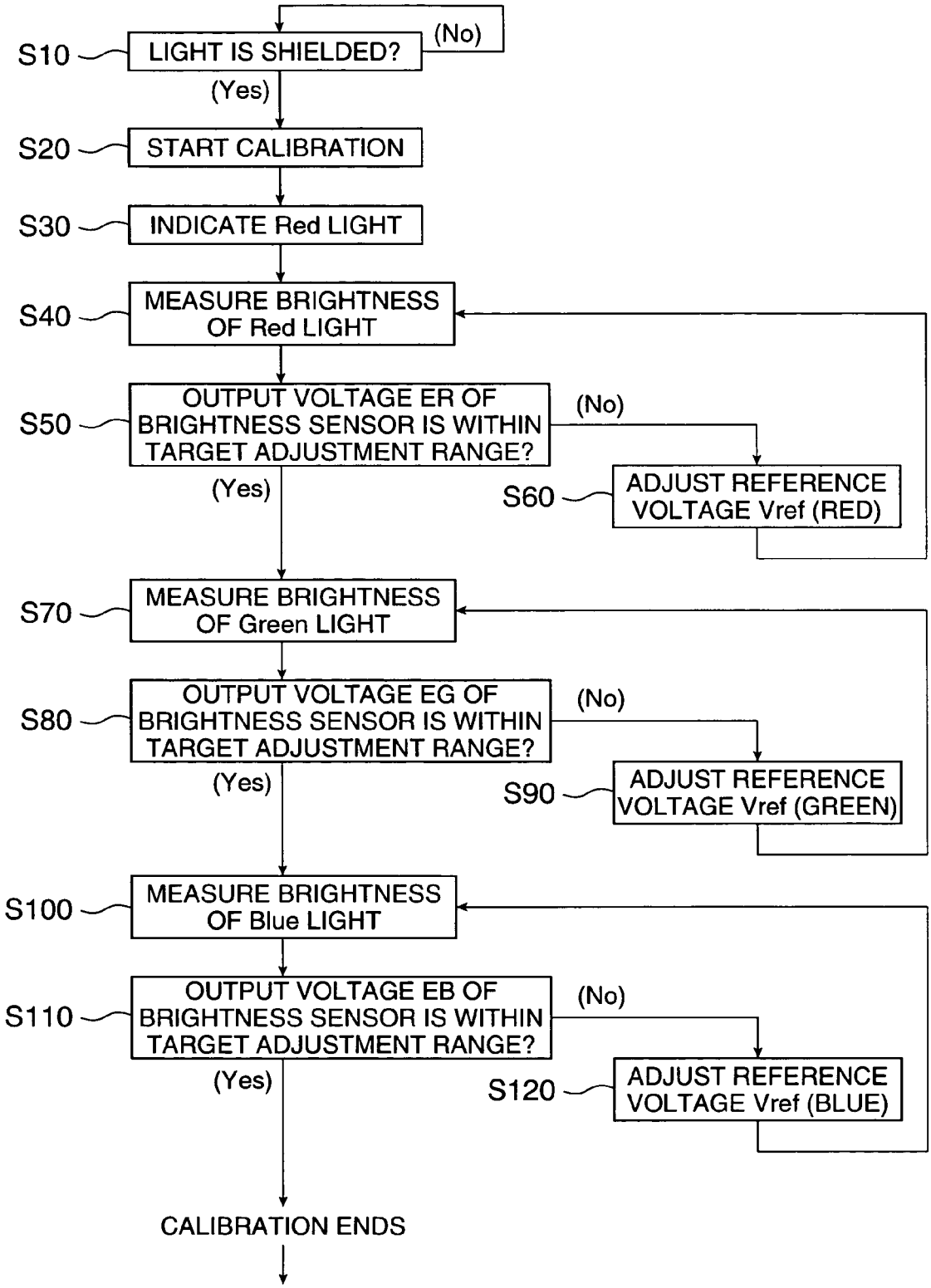
FIG. 3 is a flowchart showing a sequence control of brightness correction of the organic EL display device according to the present invention.

Specifically, as shown in FIG. 3, it is determined whether or not light is shielded (S10), and adjustment (in the figure, calibration) starts when the light is shielded (S20). Then, reference voltages Vref for R (Red), G (Green), and B (Blue) are determined in turn (S10 through S120). As depicted in a graph of the output voltage Eout of the brightness sensor with respect to an image data value shown in FIG. 6, the ideal relation between both is defined for the respective colors as target adjustment ranges centered by target values (EGtgt, EBtgt, and ERtgt). In order to achieve the ideal correspondence, appropriate adjustment step voltages (Rstep, Gstep, and Bstep) are provided for the respective colors to correct the reference voltages VrefR, VrefG, and VrefB for the respective colors.

Figure 4:
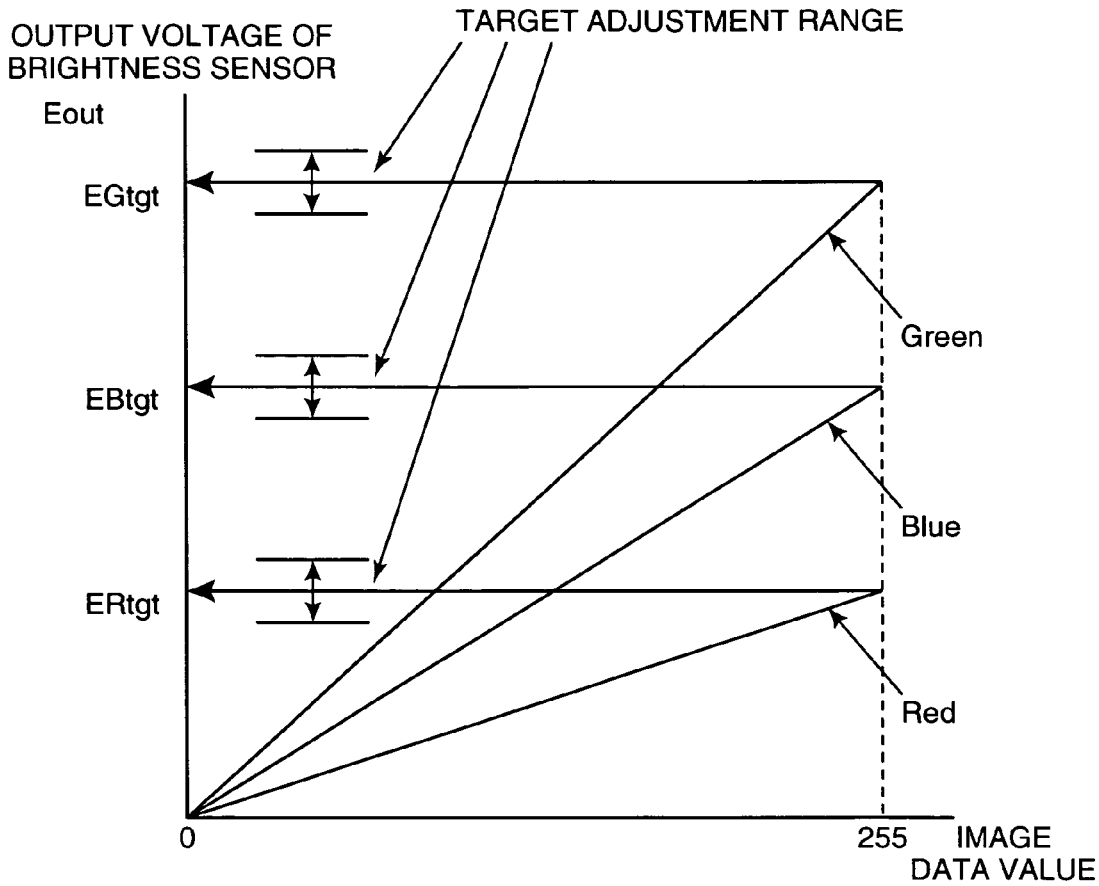
FIG. 4 is a graph of output voltage Eout of a brightness sensor in the organic EL display device according to the present invention with respect to an image data value.

First, correction for the brightness of red (Red) light is described, by way of example. As depicted in FIG. 3, when the output voltage ER (Eout) of the brightness sensor is within the target adjustment range shown in FIG. 4 (S50: YES), the brightness of other color light is corrected; or, otherwise (S50: NO), the reference voltage VrefR is adjusted (S60). The target adjustment range is a range from 0.9 times to 1.1 times the target value ERtgt of the output voltage ER of the brightness sensor. If the output voltage ER does not reach this range, the adjustment step voltage Rstep is added to the reference voltage VrefR to increase the reference voltage Vref, thereby performing control so as to bring the reduced brightness into close proximity to the target value. If the output voltage ER exceeds this range, reversely, the adjustment step voltage Rstep is subtracted from the reference voltage VrefR to decrease the reference voltage Vref, thereby performing control so as to bring too high brightness into close proximity to the target value. Subsequently, as depicted in FIG. 3, similar control is performed for each color of green and blue (S70 through S120).

Figure 5:
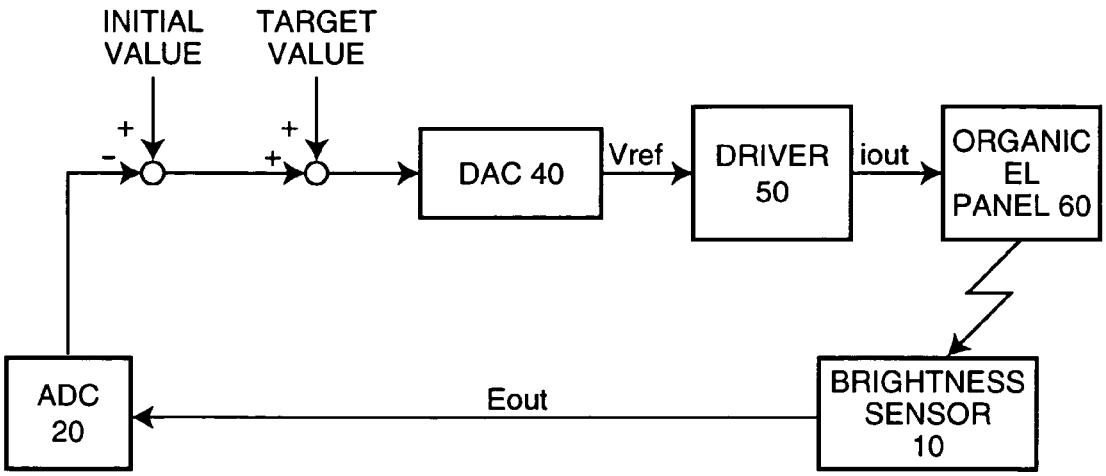
FIG. 5 is a schematic showing dynamic brightness correction of the organic, EL display device according to the present invention.

The above-described series of process steps can be expressed in the manner shown in, for example, FIG. 5. Specifically, the detected brightness result Eout of the organic EL panel is converted by the ADC 20 into a digital value, which is then compared to an initial value (for example, digital data indicating the detection result Eout at the shipment time), and the digital data is corrected so as to achieve the target value according to the comparison result. The corrected digital data is converted by the DAC 40 into an analog value, and the analog value is set as the reference voltage Vref for a DAC included in the driver 50.

The period in which the above-described series of process steps are performed is set, as required, resulting in dynamic brightness correction during continuous use.

In the above-described example, the reference voltage Vref of the DAC of the driver 50 is adjusted based on the detected brightness result. Alternatively, a drive voltage or the data itself can be adjusted or modified according to the detection result.

Figure 6:
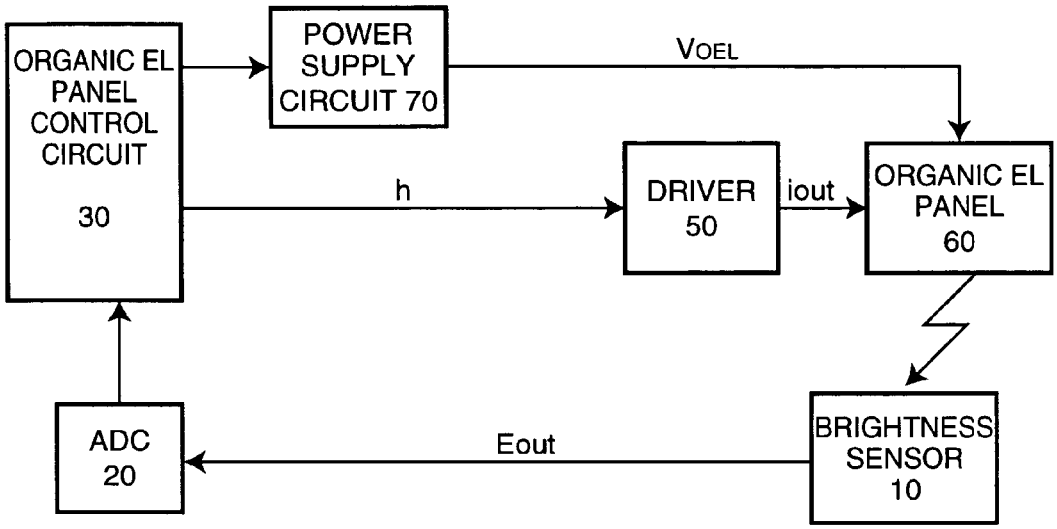
FIGS. 6(*a*) and 6(*b*) are schematics of an organic EL display device according to the present invention, where FIG. 6(*a*) is a schematic of the diagram of the overall device, and FIG. 6(*b*) is a schematic of the control of an organic EL control circuit 30.
Figure 6:
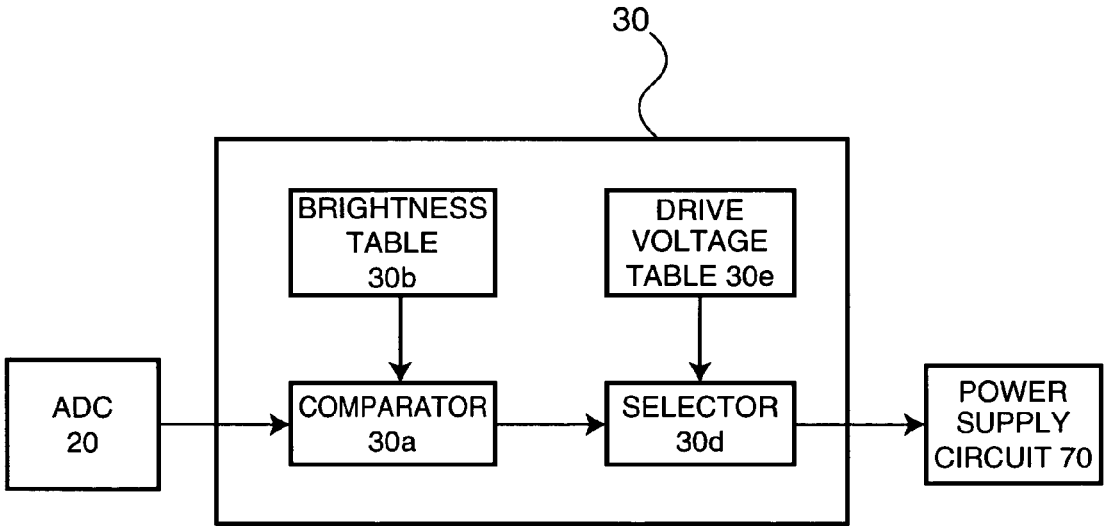

As an example, as depicted in FIGS. 6(*a*) and 6(*b*), the detection result Eout is converted by the ADC 20 into a digital signal, which is then input to the comparator 30*a* in the organic EL panel control circuit, and the comparator 30*a* refers to the predetermined brightness table 30*b* stored in a non-volatile memory or the like to determine whether or not, the detected brightness is more appropriate than the uncorrected brightness. This comparison result is output to the selector 30*d*.

For detection, preferably, the brightness is detected when a predetermined digital signal is input, and data (that is, initial data) corresponding to the detection result is stored in the brightness table 30*b* to be compared.

The selector 30*d* which receives the comparison result selects appropriate data from the data of a drive voltage table 30*e*, and outputs it to a DAC included in a power supply circuit 70. The output of this DAC defines a drive voltage Voel to be supplied to the organic EL panel.

Figure 7:
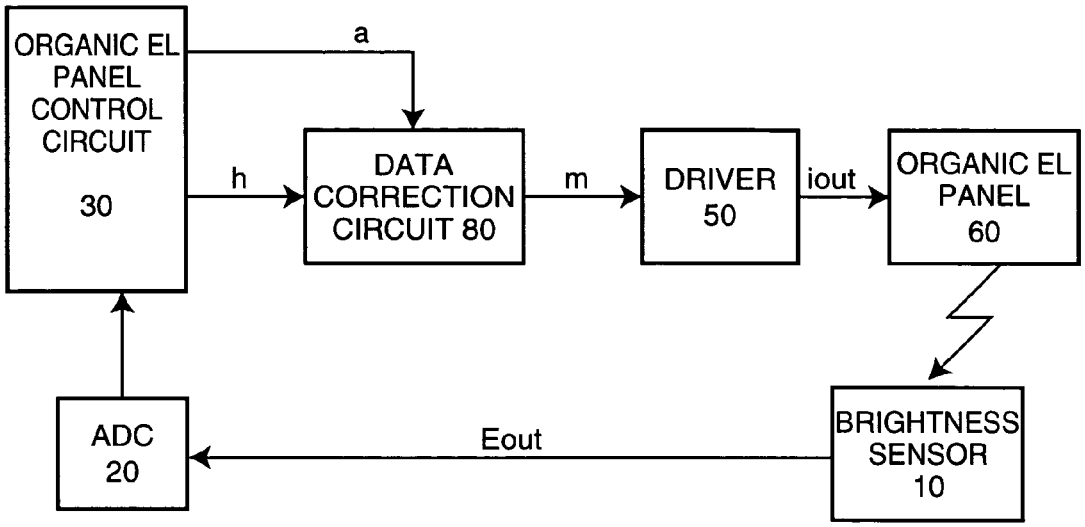
FIGS. 7(*a*) and 7(*b*) are schematics of an organic EL display device according to the present invention, where FIG. 7(*a*) is a schematic of the control of the overall device, and FIG. 7(*b*) is a schematic of the control of an organic EL control circuit 30.
Figure 7:
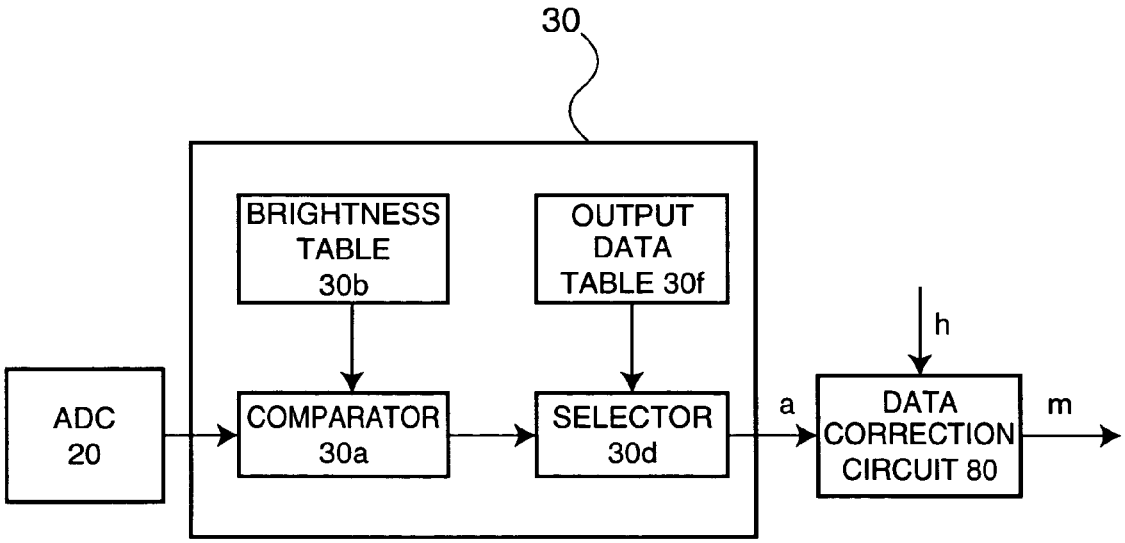

As another example, as shown in FIGS. 7(*a*) and 7(*b*), the digital data itself may be modified according to the detection result Eout. In this case, the detection result Eout is converted by the ADC 20 into a digital signal, which is then input to the comparator 30*a* in the organic EL panel control circuit, and the comparator 30*a* refers to the predetermined brightness table 30*b* stored in a non-volatile memory or the like to determine whether or not the uncorrected brightness is the desired brightness. This comparison result is output to the selector 30*d*, and appropriate data is selected from an output data table based on this output to set a reference value for correction performed by a data correction circuit 80. Digital data m corrected by the data correction circuit 80 is input to a DAC included in the driver 50, and is then converted into analog data iout, and the analog data iout is supplied to the organic EL panel.

The examples shown in FIGS. 6(*a*)-7(*b*) are also applicable to dynamic brightness correction shown in FIG. 5.

In some cases, the luminance efficiency of the organic EL elements may be dependent upon the environment temperature. In such cases, the temperature may be measured instead of detection of the brightness to feed it back to the organic EL panel in a similar way to that described above.

Figure 8:
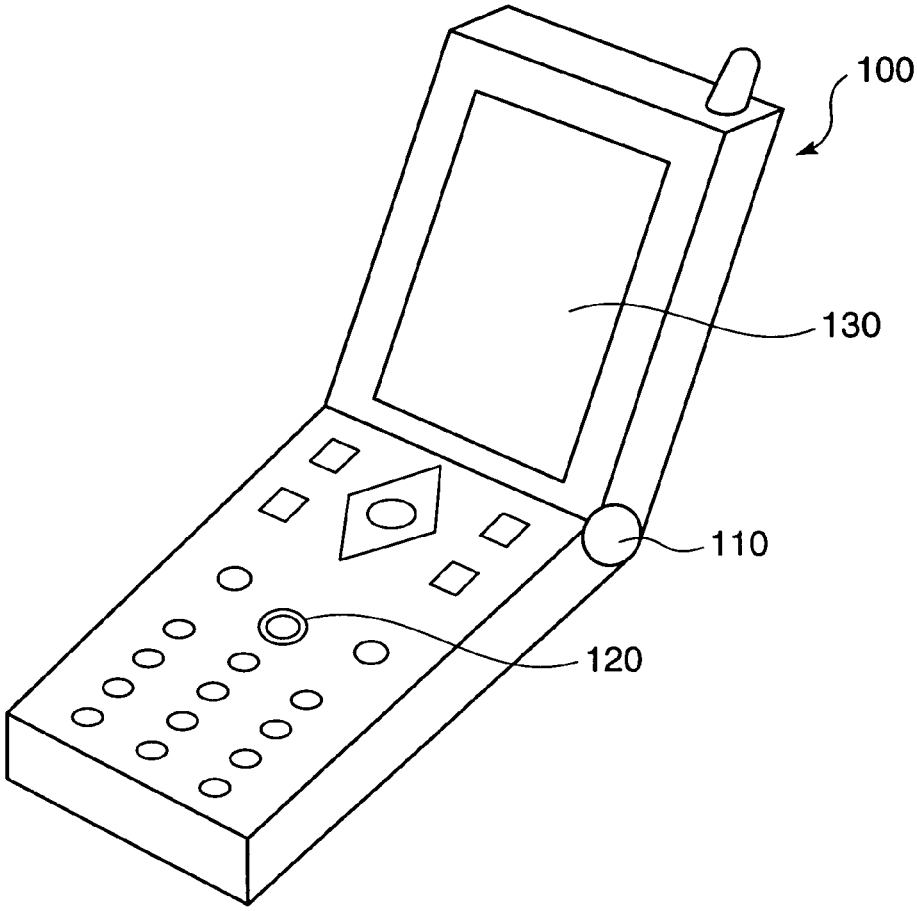
FIG. 8 is a perspective view of a folding cellular telephone 100 according to an application example of the organic EL display device as an exemplary embodiment of the present invention.

Exemplary Elements Incorporating Electro-Optical Device of the Present Invention Examples in which the aforementioned organic EL display device is applied to information terminals, such as a folding cellular telephone and a PDA, are described below. FIG. 8 is a perspective view of a folding cellular telephone 100. The cellular telephone 100 shown in FIG. 8 uses a hinge mechanism (hinge unit) 110 to achieve a two-fold element, and the cellular telephone 100 which is not folded but is open is shown.

A brightness sensor 120 is located so as to face an organic EL panel 130, thereby providing a shield structure which prevents light from the outside in the folded state of the phone, and the brightness sensor 120 is positioned at the center of this facing portion. The brightness sensor 120 can also function as a light sensor of a digital camera when it is built therein.

Figure 9:
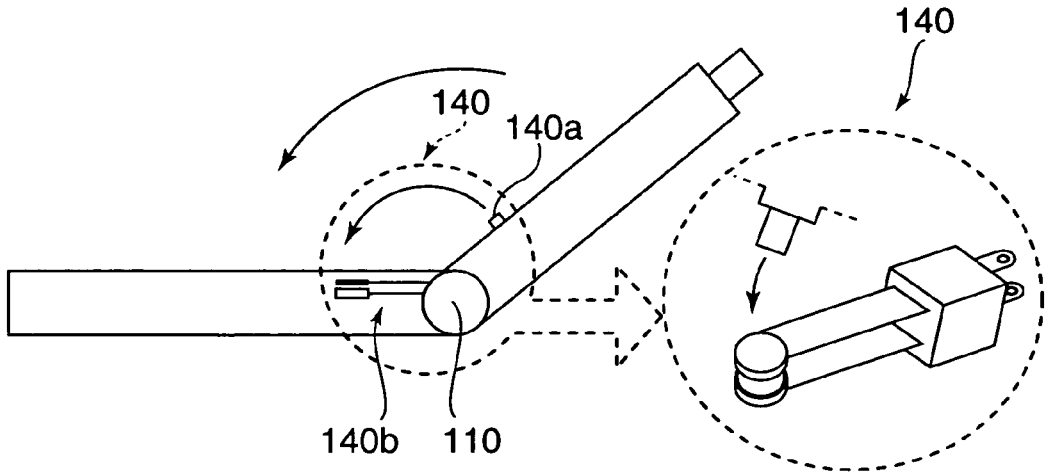
FIG. 9 is a side view of the cellular telephone shown in FIG. 8.
Figure 10:
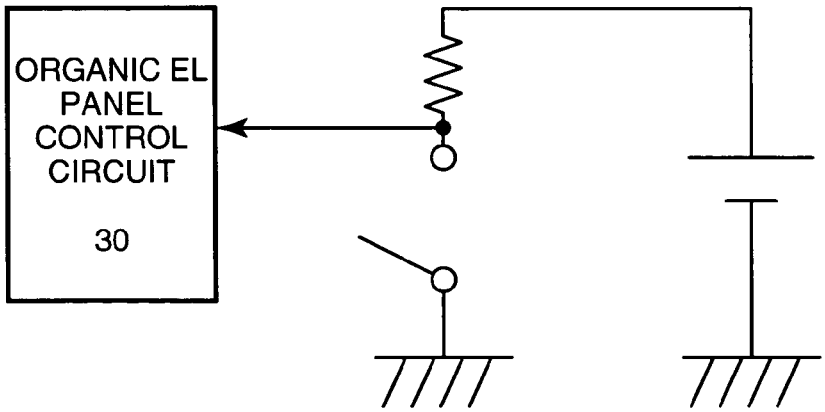
FIG. 10 is a schematic circuit diagram of a shielded light detection sensor 140 in an organic EL display device according to one exemplary embodiment of the present invention.

The hinge unit 110 includes a shielded light detection sensor 140 (brightness detectability determination unit) to determine whether or not the cellular telephone is folded, as shown in the side view of FIG. 9, so that the brightness sensor 120 can ensure accurate measurement of light brightness of the organic EL panel 130. As shown in FIG. 9, an example of the shielded light detection sensor 140 is of the leaf spring type that includes a projection 140*a* at the side of the organic EL panel 130 and a leaf spring 140*b* at the side of the brightness sensor 120. With this structure, when the cellular telephone 100 is folded for brightness adjustment, abutment of the projection 140*a* on the leaf spring 140*b* causes a conduction signal to be output, thus making it possible to determine whether or not light is shielded in the sequence of the above-noted exemplary embodiments. An equivalent circuit of the shielded light detection sensor 140 is shown in, for example, FIG. 10.

In order to detect the light shielding state, the above-described shielded light detection unit need not be additionally used, and the light shielding state may be determined when the output of the brightness sensor in the non-display state is not greater than a predetermined threshold value. In this case, there is no need for a shielded light detection sensor in addition, thus reducing the number of parts and achieving a simple structure as a whole.

In the folded but open state of the phone, the brightness sensor may also be used not only for the purpose of brightness compensation for to the degradation over time but also used as an external-light sensor for brightness adjustment of the organic EL panel so as to cancel the influence of the external light.

In the present invention, pixel colors are not limited to three colors, R, G, and B (red, green, and blue), and any other color may be used.

OTHER APPLICATION EXAMPLES

Figure 11:
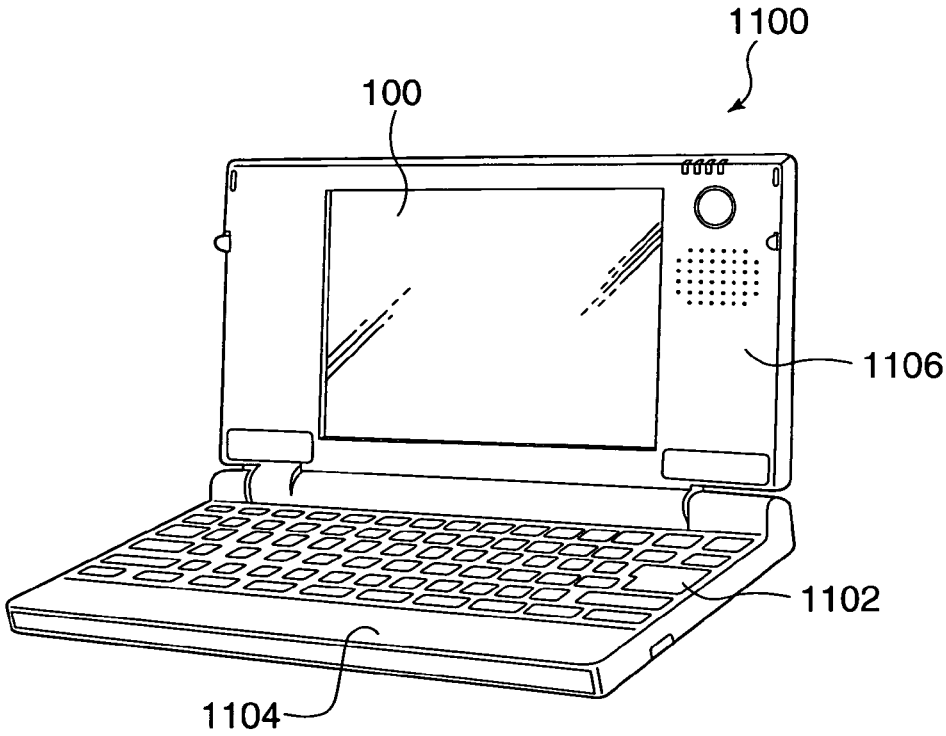
FIG. 11 is a perspective view showing an example in which the electro-optical device according to an exemplary embodiment of the present invention is applied to a mobile personal computer.

Some specific examples of the above-described electronic apparatus in which an organic EL display device is used for an electronic apparatus are described below. First, an example in which the organic EL display unit according to this exemplary embodiment is applied to a mobile personal computer is described. FIG. 11 is a perspective view showing the structure of the mobile personal computer. In FIG. 11, a personal computer 1100 includes a main body 1104 having a keyboard 1102, and a display unit 1106, and the display unit 1106 includes the above-described organic EL display device.

Figure 12:
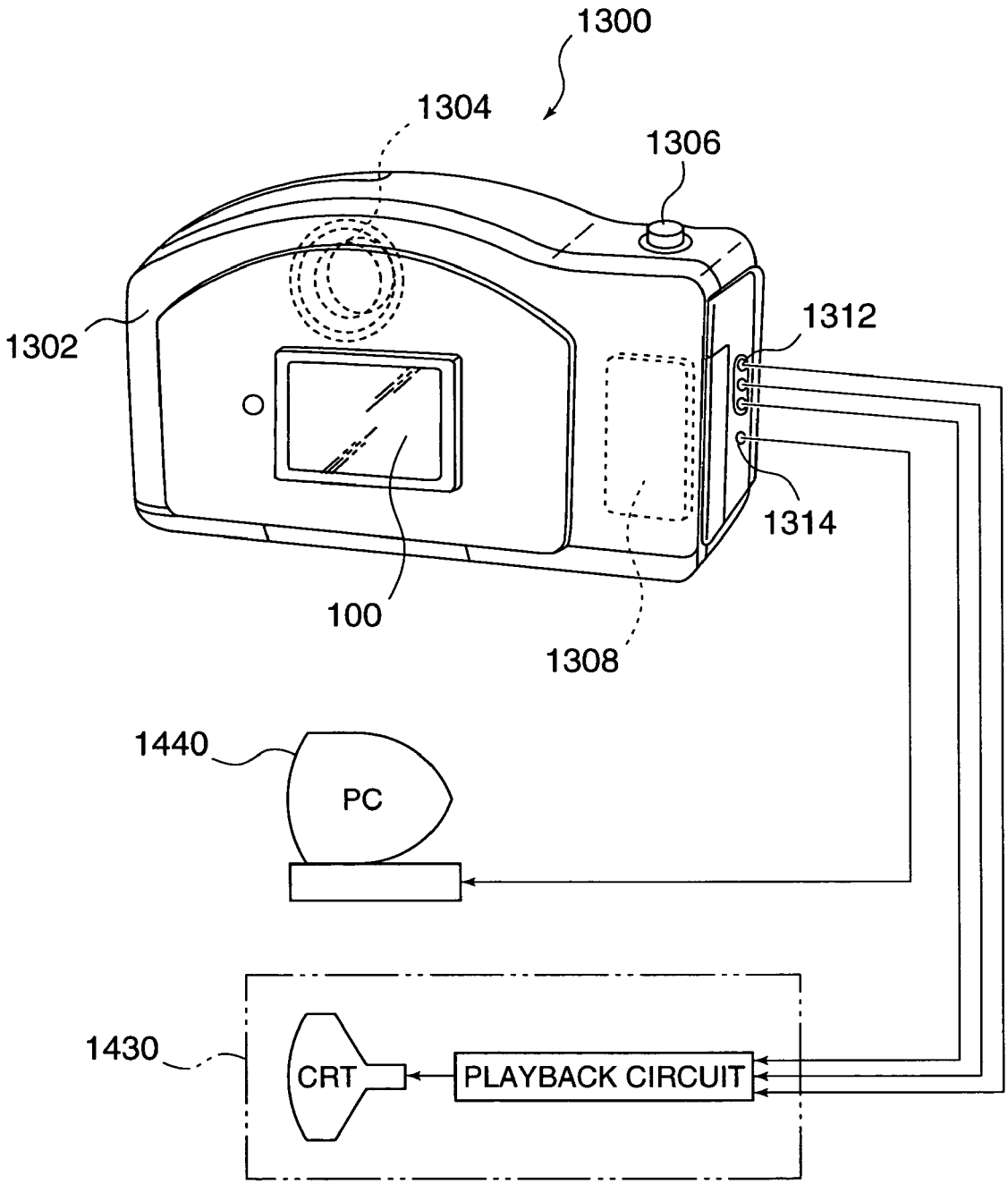
FIG. 12 is a perspective view of a digital still camera whose finder is implemented by an electro-optical device according to an exemplary embodiment of the present invention.

FIG. 12 is a perspective view showing the structure of a digital still camera whose finder is implemented by the above-described organic EL display device. In FIG. 12, a connection with an external element is also illustrated in a simple manner. While a typical camera creates an optical image of an object to allow a film to be exposed, a digital still camera 1300 photoelectrically converts an optical image of an object using an imaging element such a CCD (Charge Coupled Element) to generate an imaging signal. The above-described organic EL display device is placed on a rear surface of a case 1302 of the digital still camera 1300 to perform display based on the imaging signal generated by the CCD, and the organic EL display device functions as a finder for displaying the object. A light-receiving unit 1304 including an optical lens and the CCD is also placed on the viewing side of the case 1302 (in FIG. 12, the rear surface).

When a photographer views an image of an object displayed on the organic EL display device and presses a shutter button 1306, the imaging signal of the CCD at this time is transferred and stored in a memory on a circuit board 1308. In the digital still camera 1300, a video signal output terminal 1312 and an input/output terminal 1314 for data communication are placed on a side surface of the case 1302. As shown in FIG. 12, a TV monitor 1430 is connected to the former video signal output terminal 1312, and a personal computer 1430 is connected to the latter input/output terminal 1314 for data communication, if necessary. The imaging signal stored in the memory on the circuit board 1308 is output by a predetermined operation to the TV monitor 1430, or the personal computer 1440.

Examples of electronic apparatuses to which the organic EL display device of the present invention is applicable include, in addition to the personal computer shown in FIG. 11 and the digital still camera shown in FIG. 12, a television set, a viewfinder-type or direct-view monitor type video tape recorder, a car navigation system, a pager, an electronic organizer, an electronic calculator, a word processor, a workstation, a TV phone, a POS terminal, a touch-panel-equipped apparatus, a smart robot, a lighting element having a light control function, and an electronic book, for example. The above-described organic EL display device can be implemented as a display unit of such electronic apparatuses.

The amount of drive current to be supplied to electro-optical elements is controlled, thus enabling a change in brightness to be compensated for. Specifically, the brightness can be maintained constant, and the degradation of color reproduction of image data can be greatly reduced.

The invention claimed is:

1. An electro-optical apparatus, comprising:

a plurality of scanning lines;

a plurality of signal lines;

an electro-optical device placed at an intersection of each of a plurality of the scanning lines and each of a plurality of the signal lines;

a driver which includes a D/A converter to convert digital data into analog data and which supplies a drive current as the analog data to the electro-optical devices according to the digital data;

a brightness detection unit to continuously detect a brightness of the electro-optical devices;

a light shielding unit to continuously detect if the electro-optical device is shielded; and a reference voltage adjusting unit to adjust a reference voltage for the D/A converter based on the detected brightness result obtained by the brightness detection unit, wherein the driver adjusts the drive current according to the adjusted reference voltage and supplies the adjusted drive current to the electro-optical devices.

2. An electro-optical apparatus, comprising:

a plurality of scanning lines;

a plurality of signal lines;

an electro-optical device placed at an intersection of each of a plurality of the scanning lines and each of a plurality of the signal lines;

a driver to supply a drive current to the electro-optical devices;

a control circuit to supply to the driver a digital data corresponding to luminance data;

a brightness detection unit to continuously detect a brightness of the electro-optical devices;

a light shielding unit to continuously detect if the electro-optical device is shielded; and a data correction circuit to correct the digital data based on the detected brightness result obtained by the brightness detection unit, wherein the driver adjusts the drive current according to the corrected digital data and supplies the adjusted drive current to the electro-optical devices.

3. The electro-optical apparatus according to claim 2, the electro-optical devices including three types of electro-optical devices for R (red), G (green), and B (blue), and the brightness detection unit detecting the brightness for each of the three types of electro-optical devices.

4. The electro-optical apparatus according to claim 2, the electro-optical devices including three types of electro-optical devices for R (red), G (green), and B (blue);

the three types of electro-optical devices illuminating R (red), G (green), and B (blue) light by passing light emitted from a common light source for the three types of electro-optical devices through a color conversion unit provided for each of the three types of electro-optical devices; and the brightness detection unit detecting the brightness of the common light source as the brightness of the electro-optical devices.

5. The electro-optical apparatus according to claim 2, the electro-optical devices including three types of electro-optical devices for R (red), G (green), and B (blue);

the three types of electro-optical devices illuminating R (red), G (green), and B (blue) light by passing light emitted from a common light source for the three types of electro-optical devices through a color conversion unit provided for each of the three types of electro-optical devices; and the brightness detection unit detecting the light passing through at least one of the color conversion units of the three types of electro-optical devices for the brightness of the electro-optical devices.

6. The electro-optical apparatus according to claim 2, further comprising a brightness detectability determination unit to determine whether or not the brightness detection by said brightness detection unit is possible.

7. The electro-optical apparatus according to claim 2, a determination being made as to whether or not the brightness detection by the brightness detection unit is possible based on the brightness of the electro-optical devices detected by the brightness detection unit.

8. An electronic device, comprising:

the electro-optical apparatus according to claim 2.

9. A driving method of an electro-optical device having a plurality of scanning lines, a plurality of signal lines, an electro-optical element placed at an intersection of each of a plurality of the scanning lines and each of a plurality of the signal lines, and a driver which includes a D/A converter to convert digital data into analog data and which supplies a drive current as the analog data to the electro-optical elements according to the digital data, the driving method comprising:

detecting a brightness of the electro-optical devices continuously;

continuously, detecting, if the electro-optical device is shielded; and defining a reference voltage for the D/A converter based on the detection result obtained, wherein the driver adjusts the drive current according to the adjusted reference voltage and supplies the adjusted drive current to the electro-optical devices.

10. A driving method of an electro-optical apparatus having a drive current, a reference voltage, a plurality of scanning lines, a plurality of signal lines, and an electro-optical device placed at an intersection of each of a plurality of the scanning lines and each of a plurality of the signal lines, brightness data being supplied to the electro-optical devices via a driver, the driving method comprising:

detecting a brightness of the electro-optical devices continuously;

continuously, detecting, if the electro-optical device is shielded, and correcting the digital data based on the detection result obtained, wherein the driver adjusts the drive current according to the adjusted reference voltage and supplies the adjusted drive current to the electro-optical devices.

11. The driving method according to claim 10, the detecting including detecting the brightness for each of three colors, R, G, and B (red, green, and blue).

12. The driving method according to claim 10, further including, prior to the detecting, determining in advance whether or not the brightness detection is possible.

13. The driving method according to claim 10, further including determining whether or not the brightness detection by the brightness detection unit is possible based on the detected brightness of the electro-optical devices.

* * * * *